United States Patent [19]

Price

[11] 4,369,968

[45] * Jan. 25, 1983

[54] LIFTING BAR ASSEMBLY

[76] Inventor: Paul J. Price, 1420 Junior Dr., Pittsburgh, Pa. 15227

[ * ] Notice: The portion of the term of this patent subsequent to Feb. 24, 1998, has been disclaimed.

[21] Appl. No.: 231,933

[22] Filed: Feb. 5, 1981

[51] Int. Cl.[3] ..... A63B 13/00

[52] U.S. Cl. ..... 272/123

[58] Field of Search ..... 272/117, 122, 123, 124, 272/93, 116

[56] References Cited

U.S. PATENT DOCUMENTS

| | | | |
|---|---|---|---|
| 793,101 | 6/1905 | Schmidt | 272/122 |
| 2,676,802 | 4/1954 | O'Brien | 272/123 |
| 3,226,117 | 12/1965 | Walklet | 272/123 |
| 3,756,597 | 9/1973 | Monti | 272/123 |
| 4,103,887 | 8/1978 | Shoofler | 272/123 |
| 4,252,316 | 2/1981 | Price | 272/123 |

*Primary Examiner*—Richard C. Pinkham
*Assistant Examiner*—William R. Browne
*Attorney, Agent, or Firm*—William J. Ruano

[57] ABSTRACT

A lifting bar assembly comprising an elongated cylindrical rod over an intermediate portion of which a tube telescopically fits. A plurality of weight discs, each having a central hole and at least one hole adjacent the disc periphery are provided in abutting relationship with the ends of the tube and supported on the rod which extends through the selected hole. By selecting the hole adjacent the periphery, the assembly is highly useful for lifting in a room having a low ceiling, as in homes, so as to prevent bumping of the weights against the ceiling. As a bench press for lifting from the floor, a pair of support brackets, each having a plurality of vertically spaced holes through which the rod is slid, are supported on the floor and located between the ends of the tubes and the selected number of weights which are rigidly fastened to such ends by set screws on collars.

3 Claims, 6 Drawing Figures

LIFTING BAR ASSEMBLY

This invention is an improvement over that described in my pending application Ser. No. 06/025,832, filed Apr. 2, 1979 now U.S. Pat. No. 4,252,316.

In such earlier invention, numerous parts are required for the assembly which adds considerably to the cost as well as interfering somewhat with the lifting capability of the lifting bar. More specifically, when weights are to be added or removed from the assembly, a total of four disc weights are required in order to keep the lifting bar and weight supporting bar in balance. Moreover, since the weights are not in the plane of lift, when the lifting bar is raised, it must be done in a straight line, in a vertical plane otherwise the weights have a tendency to sway as the weights extend further and further out beyond the vertical axis extending through the lifting bar. Moreover, the disc weights are always mounted below the lifting bar, whether the lifter is doing a standing "overhead press" or a "bench press".

Furthermore, a greater amount of material and greater number of pieces are required in the above-mentioned assembly. More specifically, for one pair of brackets, there are required two pieces of iron pipe, two plates, two round bars, four collars with a set screw for each collar and four weldments, each about 3 inches long, making a total number of 14 pieces per pair of brackets.

An object of the present invention is to considerably reduce the number of parts, total weight of the assembly and the total expense by considerable amounts.

A more specific object is to reduce the number of parts so that a total of only two disc weights must be added or removed to keep the lifting bar in balance.

A further object is to also improve the relative arrangement of parts of the assembly so as to make use by the lifter more versatile.

Other objects and advantages of the invention will become more apparent from the following description together with the accompanying drawing wherein.

Figure 1:
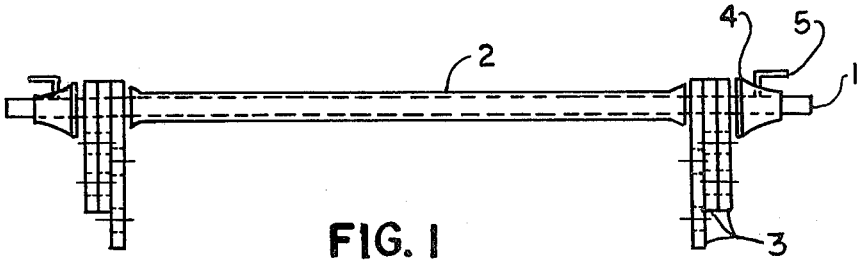
FIG. 1 is an elevational view of a complete assembly associated with the lifting bar for use as a standing overhead press.
Figure 2:
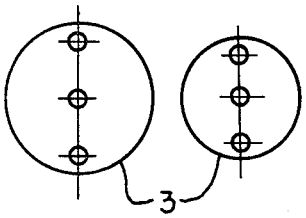
FIG. 2 is a side view of two weights, three being shown in FIG. 1.
Figure 3:
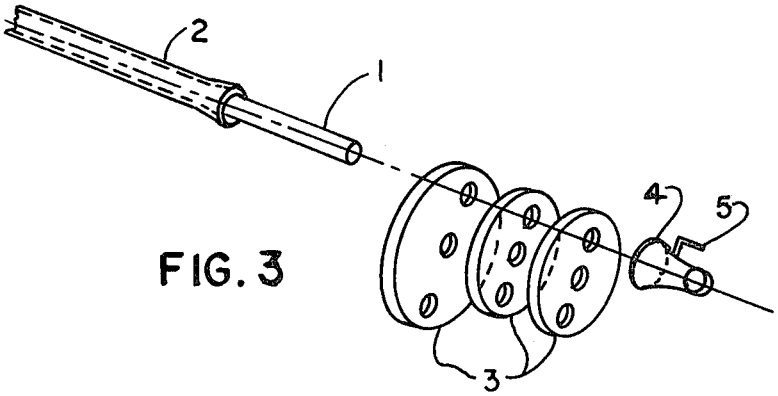
FIG. 3 is a fragmentary, perspective view of the lifting bar together with three weights at one end, it being understood that a similar arrangement is provided at the opposite end, as shown in FIG. 1.

Referring more particularly to FIGS. 1, 2 and 3 of the drawing, numeral 1 denotes a rod of solid metal, such as steel, surrounded by a telescoping lifting bar 2 having outwardly flared ends which abut against the inner surfaces of weights 3, that is, the weight of largest diameter while additional weights may be added, two additional weights being illustrated. After the selected number of weights are assembled, say three as shown in FIG. 1, the collar 4 is slid onto the rod 1 and held tightly thereagainst by turning of the set screw 5.

The assembly shown in FIGS. 1, 2 and 3 is particularly useful for raising the lifting bar 2 higher towards a ceiling of low height. In such case, since the weights 3 do not project materially above lifting bar 2, they will easily clear and not bump against the ceiling upon a standing overhead press since the disc weights are mounted by using the top hole 3*a*, as distinguished from the central hole 3*b* in FIG. 4 and in conventional lifting bar arrangements.

Figure 4:
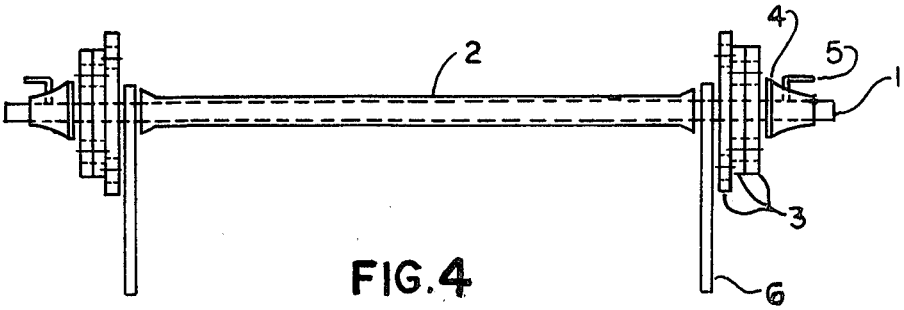
FIG. 4 is an elevational view of the assembly of FIG. 1 together with supporting brackets 6 on which it is mounted for use as a bench press.
Figure 5:
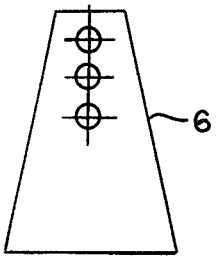
FIG. 5 is a side view of one of the supporting brackets 6.
Figure 6:
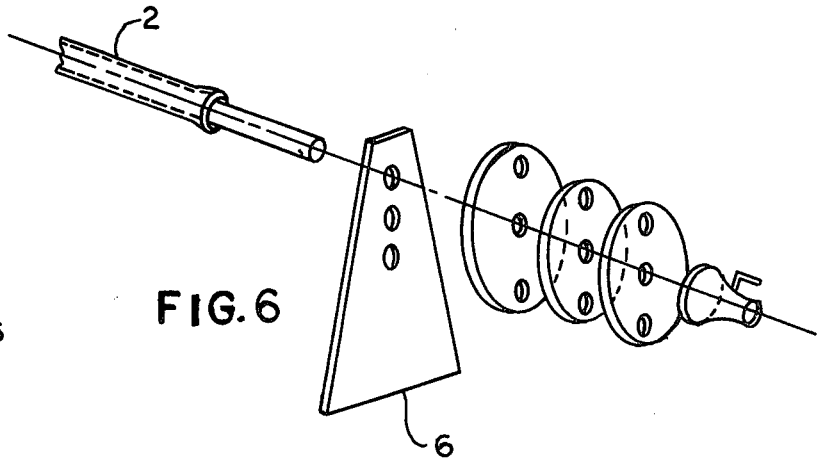
FIG. 6 is a fragmentary view of one end of the lifting bar together with the associated supporting bracket and weights shown in FIG. 4.

For a bench press where the lifter lies on the floor underneath the bar, the center holes 3*b* of the disc are used, as shown in FIG. 4, but the lifter may select the particular hole in the bracket 6 that provides the best clearance distance for him, for example, the top hole 6*a* as shown in FIG. 6. Although the disc and bracket are, at times, mounted by using off center holes, the assembly remains in balance because the weights are symmetrically centered at each side of the vertical axis. Because the discs are made by the casting process, the holes are formed therein by coring. No other process or further step is required.

For one pair of brackets, only two supporting brackets 6 are required of about 10 inches to 13 inches wide or thereabouts. Only two pieces per pair of brackets are required as compared to 14 in my previous design described above.

Thus it will be seen that I have provided a significant improvement in a lifting assembly since it is versitile in enabling the lifter to selectively use it either for an "overhead press", particularly where low ceilings are encountered since it involves moving the weights lower relative to the lifting bar, or which may be used by lying on the floor underneath the assembly for a "lifting press"; furthermore I have provided a lifting assembly involving a minimum number of parts and which can be lifted without the danger of unbalance by numerous weights not located in the lifting plane and which reduces the cost of the assembly very significantly as compared to prior devices.

While I have illustrated and described several embodiments of my invention, it will be understood that these are by way of illustration only and that various changes and modifications may be contemplated in my invention and within the scope of the following claims.

I claim:

1. A lifting bar assembly comprising an elongated solid cylindrical rod, a tube telescopically slid over said rod over an intermediate portion of its length, a plurality of weight discs abutting each end of said tube, each disc having a central hole and at least one hole adjacent the periphery of said disc, both said holes being sized to receive said rod, said rod extending through each of the holes adjacent the periphery of said discs so that most of the area of said discs extends downwardly of said rod therefore will enable the assembly to be lifted to a greater height without bumping against a low ceiling, and a collar slidably mounted on each end portion of said rod and having means for rigidly fastening it to said rod.

2. The lifting bar assembly recited in claim 1 together with a pair of supporting brackets, each bracket located between one end of said tube and said weights, said brackets having hole means through which said rod may be slid, whereby when said supporting brackets are supported on a floor, the entire assembly may be lifted by a gymnast lying on a floor underneath said rod and tube.

3. The lifting bar assembly recited in claim 2 wherein said hole means comprises a plurality of bertically spaced holes in each of said brackets through one of which holes said rod may be selectively slid.

* * * * *